US006223140B1

(12) United States Patent
Monadjemi

(10) Patent No.: US 6,223,140 B1
(45) Date of Patent: Apr. 24, 2001

(54) MULTIPURPOSE FLUID ANALOG COMPUTER

(76) Inventor: Parviz Monadjemi, #348 Kooyeh Ostaadaan, Zargari Boulevard, Shiraz 71847 (IR)

( * ) Notice: Subject to any disclaimer, the term of this patent is extended or adjusted under 35 U.S.C. 154(b) by 0 days.

(21) Appl. No.: 09/129,769

(22) Filed: Aug. 6, 1998

Related U.S. Application Data

(60) Provisional application No. 60/055,666, filed on Aug. 14, 1997.

(51) Int. Cl.[7] ..... G06G 7/48
(52) U.S. Cl. ..... 703/9; 703/6
(58) Field of Search ..... 395/500.28; 345/473; 368/56, 54; 137/518; 703/6, 9

(56) References Cited

U.S. PATENT DOCUMENTS 5,537,641 * 7/1996 Lobo et al. ..... 395/119
5,877,777 * 3/1999 Colwell ..... 345/473

OTHER PUBLICATIONS

Helmut Korbus, 'Hydraulic Modeling' published 1980, Section 13, pp. 245–263.*
Jatsuhiko Ogata, 'Modern Control Engineering' published 1990, pp. 125–130.*
Hydraulic Modeling by Helmut Kobus, 1980, Book Section 13, pp. 245–263.*
Introduction to Fluidics, J. M. Kirshner, Fluidics Quarterly, v1 n1, Jan. 1968, pp. 93–102.*
Fluidics–Basic Components and Applications, James W. Joyce and Richard N. Gottron, Harry Diamond Labs Special Report, Sep. 1979, Abstract Only.*
Helmut Kobus, 'Hydaaulic Modeling' published 1980, Section 13, pp. 245–263.*
Jatsuhiko Ogata, 'Modern Control Engineering' published 1990, pp. 126–130.*
Hydraulic Modeling by Kobus, Helmut 1980.
Introduction to Fluidics, by J.M. Kirshner 1968.
Linear Control System Analysis and Design, Conventional and Modern, D'Azzo and Houpis, 1998, pp. 60–62.
Fluid mechanics with Engineering Applications, Robert Daugherty and Joseph Franzini, 1965, pp. 395–396.
Modern Control Engineering, Katsuhiko Ogata, 1990, pp. 126–130.

* cited by examiner

*Primary Examiner*—Kevin J. Teska
*Assistant Examiner*—Lonnie A. Knox
(74) *Attorney, Agent, or Firm*—Robert N. Blackmon

(57) ABSTRACT

An apparatus (or a multitude of apparati) for modeling the solution (or the results) of a set of differential equations including single differential equations comprising fluid circuits having reservoir units (RUs) of various shapes to store and release fluids and friction units (FUs) to resist (in a linear or nonlinear manner) the flow of fluids. The fluid circuits can be arranged in series, parallel, loop or combinations thereof forming a system defined by a set of linear, nonlinear or combination thereof of differential equations. The system is under various forcing function where the forcing functions can comprise continuous, discontinuous, constant, variable, periodic flow and potential heads applied at least to one reservoir units (RU). The inputs results in outputs in all reservoir units (RUs) and friction units (FUs) and the outputs are monitored and are solutions to the set of differential equations defining the system.

22 Claims, 4 Drawing Sheets

MULTIPURPOSE FLUID ANALOG COMPUTER

This application claims benefit of application No. 60/055,666, filed Aug. 14, 1997.

BACKGROUND AND SUMMARY OF THE INVENTION

The present invention relates to fluid flow analog computers or systems in contrast to the electric flow analog computers. It particularly relates to physical components and methods for building up and the process of utilizing such systems. This invention in particular uses the potential head and the flow of any fluid as the input signals to the fluid analog computer. There are two physical components or basic units, which make up the main parts of the invention, namely the friction units (FU) and the reservoir units (RU). The flow of the fluid through any friction unit causes loss of potential head, while the reservoir unit stores or releases the fluid. The large number of basic units arranged in various configurations makes possible the construction of many liquid analog computers, the subject of the present invention. Different flow and/or potential head signals as inputs will result in observable and measurable response signals in the system, thereby allowing the solution of many problems. These problems are mainly defined by differential equations.

There are a few types of analog computers and analog models, but to the inventor's knowledge there are no analog computers which use liquids as the flowing medium. There is an analog model, which uses liquid flow in a thin slot between two smooth plates. This is the so-called Hele-Shaw model which is mathematically similar to the liquid flow in a two dimensional potential flow. On the other hand and almost in all cases an analog computer, which is used to solve differential equations, uses electrical flow and electrical circuits.

In the present invention fluid circuits comprising friction units and reservoir units are utilized to construct fluid analog computers for the solution of real world problems defined by differential equations. In addition to the friction units and reservoir units, which make up the basic physical components of the systems, the fluid analog computer may contain at least one terminal reservoir unit (TRU). The terminal reservoir unit may be a simple constant-level overflow device. The flow medium, that flows through the basic units, may be any type of fluid such as oil, water, gas, air, etc.. The friction unit consists of any device that resists the flow of fluids. The laminar, transient and turbulent flow of any fluid through the friction unit causes loss of potential head. In one preferred embodiment, the friction unit consists of a tube filled with granular material. There are many other types and forms of friction units suitable to be used in the fluid analog computer. The reservoir unit consists of any device capable of storing or releasing the fluid. The change of the liquid level or fluid pressure in reservoir units will change the rate of fluid flow through the friction units. In one preferred embodiment the reservoir unit is a transparent hollow cylinder. The basic units, the friction and reservoir units, are arranged and interconnected in a variety of configurations. This process of arranging and interconnecting various basic units forms one of the backbones of the present invention.

In operation any continuous, discontinuous, constant, variable, periodic, etc., type of flow or head may be imposed on one or more of the reservoir units. These forcing functions, sources and/or sinks may be obtained by special pumps, outputs of other fluid analog computers, and special devices such as springs and machines producing vertical (up and down) motions. The response signals, in terms of fluid flows or fluid pressures, produced by the specific configuration of the physical components of the system and by the input signals are definable by differential equations. The solutions to these differential equations are the measurable response signals produced by the present invention.

It is an object of the present invention to provide fluid analog computers of exceedingly simple conception, construction and operation. The primary advantage of the present invention is that one of the response signals or variables (the potential head) is readily observable by the naked eye in the fluid analog computer. Therefore the variables or the solutions to the differential equations may be sensed and visualized. The visualization and observation of the solution assigns a great value to the invention as an instrument for educational and instructional purposes. It is also a great process for understanding, investigating and designing real world problems and systems by solving the applicable differential equations.

One of the principle objectives and advantages of the fluid analog computer is that it is readily adaptable to existing and widely available instrumentation, including digital computers, for measuring, indicating, recording and monitoring the variables and for furthers computations.

Another advantage is the capability of the system to be frozen or stopped at any moment in time for further investigation of a particular state. In contrast one cannot stop the electro-analog computers.

A further advantage of the fluid analog computer is its capability to extend the number of basic units in one or more directions. This creates other independent variables, such as distance, in addition to time. In one version, the extension of the basic units to all three spatial directions will produce an analog model suitable for the simulation of many complicated real world problems, like the flow of liquids in porous media.

Still another objective of the present invention is to observe and record the solution of nonlinear differential equations, some of which are very difficult and/or very costly to solve by mathematical means.

An extremely valuable advantage of the fluid analog computer, is that the fluid levels are observable directly in their natural state. This advantage enables one to intuitively visualize, sense and predict the solution to many problems defined by differential equations.

It is an object of the invention to provide improved elements and arrangements thereof in an apparatus for the purposes described which is inexpensive, dependable and fully effective in accomplishing its intended purposes.

While one skilled in the art would appreciate that fluid encompasses liquids and gases, the terms fluid, liquid, and gas will be used interchangeable and understood that the apparatus according to the present invention can operate with either regardless of the term used to explain an embodiment of the invention. And likewise, the respective pressure and potential head developed by these fluids will also be used interchangeably and should not be read as a specific limitation inherent in the system.

DETAILED DESCRIPTION OF THE INVENTION

Figure 1:
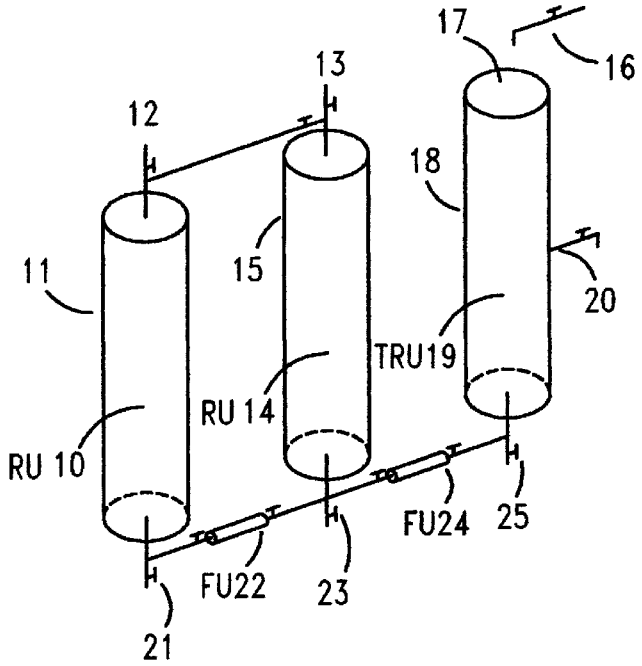
FIG. 1 is a perspective view of one of infinite possible configurations of the present invention.

For the purpose of this application, the description of the invention is broken into the following three sections:

A. Physical structure and components according to the drawings and the preferred embodiment of the invention.

B. Operation of the invention including underlying principles and specific examples.

C. Other embodiments of the invention.

A. Physical structure: A simple analog computer is illustrated by its different views in FIGS. 1, 2 and 3. It comprises two reservoir units ("RU"), RU10 and RU14, two friction units ("FU"), FU22 and FU24, and a terminal reservoir unit ("TRU"), TRU19. These unit, are connected to each other through pipe works and tubing as shown on the drawings; RU10 is connected to FU22; FU22 is connected to RU14; RU14 is connected to FU24, and FU24 is connected to TRU19. RU10 and RU14 are hollow cylindrical containers, the walls 11 and 15 are formed of any suitable material and are preferably transparent. In the embodiment shown RU10 and RU14 have closed tops including valve and inlet lines 12 and 13 shown in simplified line drawings. The valves may be closed or may be opened to keep the air pressure inside RU10 and RU14 at atmospheric pressure. The bottoms are also equipped with valves and lines 21 and 23. The size of the RU10 and RU14 vary from less than an inch to several feet in diameter and from less than a foot to several yards in height. The sizes of RU10 and RU14 need not be the same. TRU19 is a cylindrical container equipped with line and valve 25 with overflow device, 20 to maintain a constant fluid level in TRU19. The wall 18 may be the same material as the walls 11 and 15. The valve and line 16 serves as a fluid supply line to keep fluid levels in TRU19 constant at the level of overflow device 20. The connections between the units RU10, FU22, RU14, FU24 and TRU19 are secured through any suitable flexible or non-flexible tubing or pipe-works. The size of the connections and the flow through the system are such that the velocities are very small and the head losses negligible.

Figure 4:
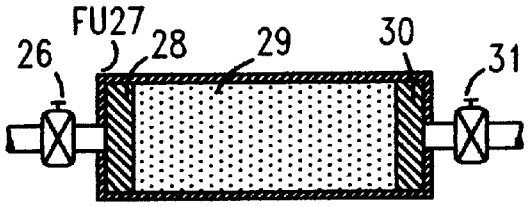
FIGS. 4 and 5 are respectively, a longitudinal and a transverse cross sectional view of one form of the friction unit.
Figure 5:
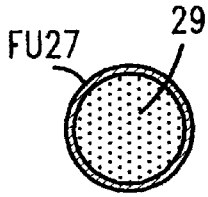
Figure 6:
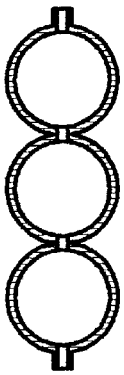
FIGS. 6, 7, 8 and 9 are vertical sectional elevations of non-cylindrical reservoir units.
Figure 7:
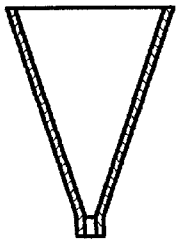
Figure 8:
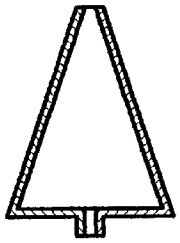
Figure 9:
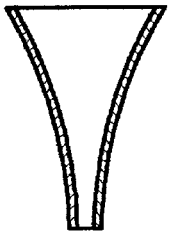

The enlargement of the friction units according to a preferred mode is shown in FIGS. 4 and 5. FU27 is cylindrical and is equipped with valves 26 and 31 to open or shutoff the unit. The friction units are so placed to keep them always full of fluid. Each friction unit has two porous stones 28 and 30 or similar devices to contain the granular material 29. The size of the friction unit and its appurtenances vary depending on the size and operational needs of the fluid analog computer. The fluid levels shown in FIG. 2 as x, $x_o$ and y are explained in Example I below. There are many ways to model a non-linear differential equation or differential equations with variable coefficients with the present invention. One way is to use non-cylindrical reservoir units shown in FIGS. 6, 7, 8 and 9. The number of spheres in FIG. 6, the wall slopes of the cones in FIGS. 7 and 8, and the curvature of the formed tube in FIG. 9 are chosen to suit the problem at hand.

Figure 10:
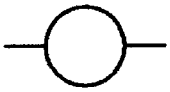
FIGS. 10, 11 and 12 are symbols chosen in this specification respectively for reservoir units, terminal reservoir units and friction units.
Figure 11:
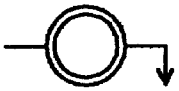
Figure 12:
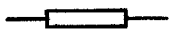

These specifications show the many different configurations of the basic units that can be put together to construct any desired fluid analog computer. FIGS. 10, 11 and 12 show respectively the symbols for a reservoir unit, a terminal reservoir unit and a friction unit. The arrow pointing down in FIG. 11 symbolizes and indicates that the fluid is freely flowing out of the terminal reservoir unit.

Figure 14:
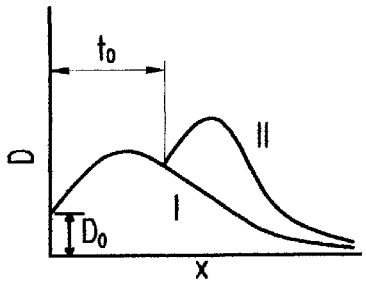
FIG. 14 is a graph, showing the fluid level simulating oxygen deficit as a function of time, corresponding to Example II at the end of this specification.
Figure 13:
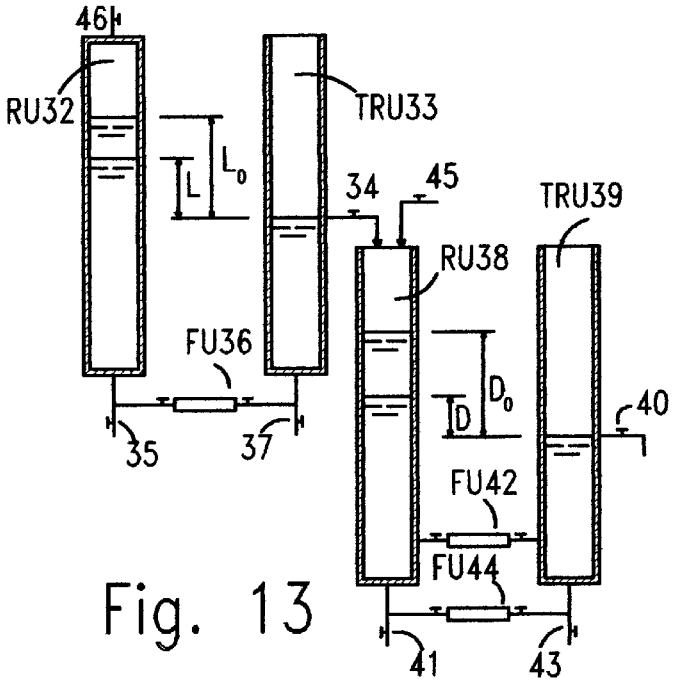
FIG. 13 is a vertical sectional elevation of a simple fluid analog computer consisting of two subsystems. The output of the first, shown on the upper left of FIG. 13, flowing freely into the second, shown on the lower right of FIG. 13.
Figure 15:
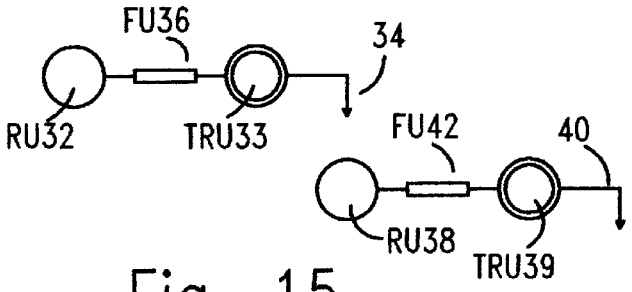
FIG. 15 is the symbol representation of the fluid analog computer of FIG. 13.

Another fluid analog computer is illustrated in FIG. 13. This system comprises two subsystems ("basic fluid circuits"). The first subsystem, shown on the upper left of FIG. 13, comprises RU32, FU36 and TRU33. The output of the first subsystem flows freely through overflow device 34 as a flow input to the second subsystem. The second subsystem, shown on the lower right of FIG. 13, comprises RU38, FU42 and FU44 and TRU39. TRU39 is equipped with constant level overflow device 40 and valve and line 43. The system is also equipped with valve and lines 46, 35, 37, and 41. There is also a valve and line 45 to serve RU38, RU32, FU36 and FU33 are connected through any suitable tube or pipe-works. Likewise RU38, FU42, FU44 and TRU39 are connected in a similar fashion. The fluid levels indicated by L, $L_o$, $D_o$ and D in FIGS. 13 and parameters $D_o$ and $t_o$ in FIG. 14 are referred to in Example II below. FIG. 15 is the symbolic representation of the fluid analog computer shown on FIG. 13. FIG. 15 comprises, from left to right RU32, FU36, TRU33 and freely flowing outlet 34. These units respectively represent components RU32, FU36, TRU 33 and 34 shown and indicated on the first subsystem of FIG. 13. The remaining symbols of FIG. 15, RU38, FU42, TRU39, and free flowing output 40 respectively correspond to RU38, FU42 and TRU39 and 40 shown and indicated on the second subsystem of FIG. 13. Note that in FIG. 13 that FU42 and FU44 connect RU38 to TRU39. However in FIG. 15 only FU42 is used to represent the two friction units. The actual number of such friction units, especially in cases where friction units are located at different levels are better represented and shown on the vertical sectional elevation than on the symbol representation of the fluid analog computers.

Inherently, the principles and concepts of the present invention allow one to start from a simple system and then construct and build a very large number of fluid analog computers by adding additional basic units. One simple fluid analog computer comprises a pair of reservoir units and friction units (RU-FU) and RU32-FU36 connected to TRU33 as shown in FIG. 13. If we use two pairs of RU-FU in series (RU 10-FU22 and RU14-FU24 connected to TRU19) we get the fluid analog computer shown on FIG. 2. One may expand the series connection of the basic units and build up a fluid analog computer to include more pairs of RU-FU; for example, three pairs, four pairs, five pairs, ten pairs, etc., with one terminal reservoir unit at the end. There are of course other configuration and expansion paths to follow in addition to the straight series connection of the basic units. For example, the fluid analog computer shown in FIG. 2 may be expanded using an extra friction unit to connect reservoir unit RU10 directly to TRU19 to form a very simple loop containing two reservoir units, three friction units and one terminal reservoir unit (not shown on the drawing). More complex analog computers may contain multiple loops and branches with one terminal reservoir unit. There may also be two or more terminal reservoir units attached to a fluid analog computer. Between any two reservoir units there may be more friction units connected, all at the same level or each at a different level. The reservoir units of the present invention may also be placed at different levels or elevations with respect to each other.

Figure 16:
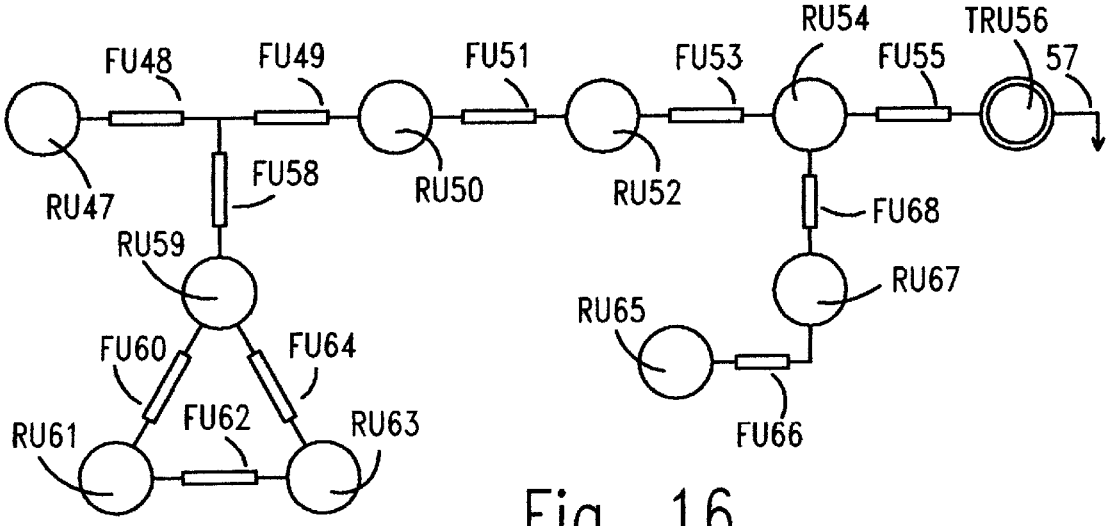
FIG. 16 is the symbol representation of one fairly large and complex fluid analog computer.

A somewhat more complex fluid analog computer is shown in FIG. 16, using symbols defined previously in FIGS. 10, 11 and 12. The fluid analog computer of FIG. 16 contains RU47, RU50, RU52, RU54, RU59, RU61, RU63, RU65, RU67, FU48, FU49, FU51, FU53, FU55, FU58, FU60, FU62, FU64, FU66, and FU68. There is a terminal reservoir unit TRU56 and a free overflow device 57. Note the connection of the FU48, FU49 and FU50 to a common point. There is also a triangular loop in the fluid analog computer of FIG. 16. Using RU52, FU53, RU54, FU55, TRU56 and 57 by shutting off or disconnecting all the other unit transforms the fluid analog computer of FIG. 16 to that of FIG. 2. One skilled in the art would appreciate that there are numerous other possibilities to alter the system of FIG. 16.

B. Operation: The fundamental principles according to which the present invention operates are outlined below and specific examples are provided to show the use and utilization of two fluid analog computer. However, the claims should not be limited to the scope of these examples. In the following two examples the differential equations defining the behavior of each fluid analog computer are derived using the fundamental laws of fluid flows, material balance and configuration, and layout of the basic units of fluid analog computer and the input signals imposed on the system.

In operation, each of the fluid analog computers shown and illustrated in FIGS. 2, 13, 15 and 16 or any of the vast number of other fluid analog computers inherent in the present invention forms a system and behaves like a system. Each fluid analog computer, made up of any number of physical components, is able to process a set of signal or inputs to yield another set of signals or outputs. Each fluid analog computer is characterized by the laws governing the mechanics of fluids, the number and layout of its physical components, and by the input signals imposed on its physical component. This information allows the derivation of differential equations sufficient and necessary to define the complete response or output of the system. The solutions to the differential equations by analytical means or numerical computations could be costly and time consuming. But the solutions by analog computers such as the present invention are readily obtainable. To use any fluid analog computer as a tool for analysis it is sufficient to measure the response or the output for any given or desired set of input signals. Many non-linear differential equations defining real world problems can be analyzed by the present invention. The utilization and operation of the fluid analog computer for design purposes is more complicated. Here the problem is how to determine the number, layout, dimensions and other characteristics of the physical components of a fluid analog computer so that a desired set of differential equations governing the problem at hand is produced.

There are two different fundamental types of input signals to be imposed separately or simultaneously on the fluid analog computer, namely flow signals and potential head signals. The flow signals may be imposed, as sources and/or sinks, on any and each unit of the fluid analog computer. For example, in FIG. 2 periodic (sine) flow may enter the reservoir unit RU10 through valve and line 12 while another type of flow may be allowed to discharge as a sink from RU14 through valve and line 23. The resulting output signals the flow in FU22 and FU24 and the fluid levels in RU10 and RU14 may be measured, indicated, monitored or recorded by proper instrumentation. One may also use the output flow of one fluid circuit, to serve as the input flow signal to another fluid circuit. In FIG. 13 the outflow 34 is used as the input to RU38. There are many other patterns of flow signals, such as flow pulses of known duration, which can be imposed on the system.

Figure 17:
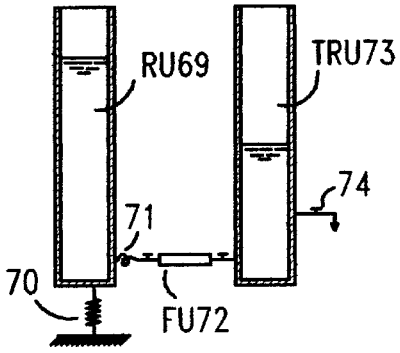
FIG. 17 is a basic fluid circuit with a spring attached to reservoir unit.

Potential head signals as modes of input may also be imposed on any and each of the reservoir units. For example, one could operate the fluid analog computer of FIG. 2 by imposing gradual vertical movement or up and down sinusoidal vertical motion on RU10. These movements may be realized by installing a spring under RU10 or by installing special machines, available commercially, to impose desired head inputs on RU10. Obviously in such cases the connections between 22 and 21 must be long enough and flexible. In FIG. 17, spring device 70, RU69, flexible tubing 71, FU72, TRU73, and valved outlet 74 are shown. The preferred flow medium to be used is liquid (water, oil, etc.), but gases or air may just as well be used to flow through the units which must be airtight. In such systems the pressure applied to the system serves as the input signal. The response signals from such aero-analog computers, such as the flow in friction units and pressure in reservoir units, may be measured by suitable instruments. The following two examples worked out in detail further illustrate the use and operation of fluid analog computers.

EXAMPLE I

Figure 2:
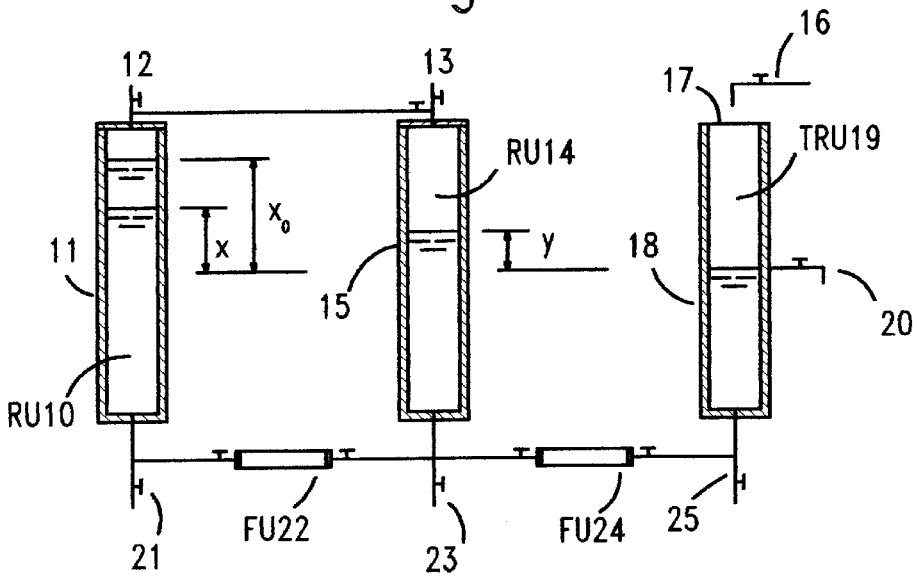
FIG. 2 is a vertical sectional elevation of a simple fluid analog computer corresponding to FIG. 1.
Figure 3:
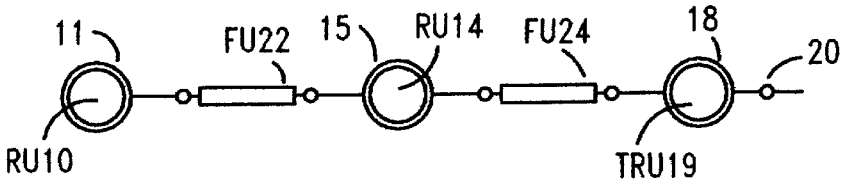
FIG. 3 is a sectional plan view corresponding to FIG. 1.

The output of the fluid analog computer shown in FIG. 2 is analyzed. The only forcing function or input is the potential head or the liquid level in RU10, initially $x_o$ above the overflow device 20. The initial fluid levels in RU14 and RU19 are at the level of overflow device 20. At time t=0 all the closed valves are opened except for RU21, RU23 and RU25. It is easily visualized that the fluid level in RU10 x continuously drops, but in RU14 y rises and reaches a peak and then drops more slowly. One could also easily sense, visualize and predict the qualitative change in x and y for other initial conditions, e.g., if $x_o<0$, or if there is an initial fluid level in RU14 above or below the overflow level 20, etc. The mathematical analysis of the situation shown in FIG. 2 follows. Darcy's law of fluid flow through FU22 and FU24 and material balance in reservoir units RU10 and RU14 at time t, when fluid levels are respectively x and y result in:

$$q_{22} = A_{22}v_{22} = A_{22}k_{22}\frac{x-y}{l_{22}} \quad \text{Equation (1)}$$

$$q_{22} = -A_{10}\frac{dx}{dt} \quad \text{Equation (2)}$$

$$q_{24} = A_{24}v_{24} = A_{24}k_{24}\frac{y}{l_{24}} \quad \text{Equation (3)}$$

$$q_{22} - q_{24} = +A_{14}\frac{dy}{dt} \quad \text{Equation (4)}$$

Where $q_{22}$, $A_{22}$, $v_{22}$, $k_{22}$ and $l_{22}$ are respectively the flow, cross sectional area, face velocity, Darcy's coefficient and length corresponding to FU22. $A_{10}$ and $A_{14}$ are respectively the cross sectional areas of RU10 and RU14; $q_{24}$, $A_{24}$, $v_{24}$, $k_{24}$, and $l_{24}$ are respectively the flows, cross sectional area, face velocity, Darcy's coefficient and length corresponding to FU24. And dx, dy and dt are the differentials of the variables x, y and t. The four equations (1), (2), (3) and (4) and the four variables x, y, $q_{22}$ and $q_{24}$ are changed to a system of two differential equations (5) and (6) in x and y by eliminating $q_{22}$ and $q_{24}$.

$$\frac{dx}{dt} = -a(x-y) \quad \text{Equation (5)}$$

$$\frac{dy}{dt} = -by + c\frac{dx}{dt} \quad \text{Equation (6)}$$

Note that this is a system of two differential equations.

Where quantities:

$$a = \frac{A_{22}k_{22}}{A_{10}l_{22}} \quad b = \frac{A_{24}k_{24}}{A_{14}l_{24}}, \; c = \frac{A_{10}}{A_{14}}$$

For the initial condition, $x_o$, see FIG. 2. Elimination of x results in the second order differential equation (7).

$$\frac{d^2y}{dt^2} + (a+b-\text{ac})\frac{dy}{dt} + aby = 0 \quad \text{Equation (7)}$$

Analytic solutions to the system of Equations (5) and (6) or (7) are available. The solutions, y and x as a function of t, which was sensed and visualized beforehand, may also be easily read off the fluid analog computer by recording the fluid level in RU14 (and in RU10). There are other cases, like periodic input flows or any other flows in and out of RU10 and/or RU14. One also could use spherical and/or other shapes for RU10 and/or RU14. The system could be so designed that the mathematical models describing it become non-linear differential equations. The solutions to such non-linear equations may not be available and it is time consuming to model them for different and varying conditions on digital computer. However, the solutions to such non-linear systems may be easily performed on the fluid analog computer.

EXAMPLE II

The simple fluid analog computer in FIG. 13 was developed as a design problem to simulate and solve the classical river pollution problem. It may, of course, be used for other purposes as well. Briefly, in river pollution problems as the organic pollution enters a river and moves downstream it becomes oxidized and is used up. The oxygen in the river is also used up (de-oxygenation process) and there will be oxygen deficit with respect to oxygen saturation level. At the same time oxygen is transferred from the atmosphere to the river (called re-aeration process). Re-aeration process offsets the effect of de-oxygenation and eventually causes the deficit to decrease. Depending on the deficit the river ecosystem may be affected and/or severely damaged.

The sub-system RU32, FU36 and TRU33 in FIG. 13 and the output from 34 to RU38 was so designed to represent the de-oxygenation, which causes the deficit D to increase. The subsystem RU34, FU44 and TRU39 was so designed that the flow through FU44 represents re-aeration, which causes the deficit D to decrease. The two sub-systems combine to produce the desired differential equation modeling the classical river pollution problem. The continuous discharge of organic pollution into a river causes an initial pollution concentration $L_o$ (FIG. 13) in the river at the point of discharge, at zero time (or zero distance). In addition L, represents pollution concentration at time (or distance) t, and $D_o$ and D represent (see also FIG. 14) the oxygen deficit in the river respectively at time zero and at time t downstream from the point of pollution.

The analysis of the problem at hand at time t using the laws governing the fluid analog computer of FIG. 13 when all the valves are open except 35, 37, 41, 43 and 45 results in the following: (FU42 is also kept closed).

$$q_{36} = A_{36}v_{36} = A_{36}k_{36}\frac{L}{l_{36}} \quad \text{Equation (1)}$$

$$q_{36} = -A_{32}\frac{dL}{dt} \quad \text{Equation (2)}$$

Equations (1) and (2) result in Equation (3). The solution to Equation (3) is Equation (4).

$$\frac{dL}{L} = -\left(\frac{A_{36}k_{36}}{A_{32}l_{36}}\right)dt \quad L = L_o @ t = 0 \quad \text{Equation (3)}$$

$$L = L_o e^{-kt} \quad \text{Equation (4)}$$

Where: $q_{36}$, $A_{36}$, $v_{36}$, $k_{36}$ and $l_{36}$ are respectively the flow, cross sectional area, face velocity, Darcy's coefficient and length corresponding to FU36; $A_{32}$ is the cross sectional area of RU32. And $k = A_{36}\ k_{36}/A_{32}\ l_{36}$ which is constant and corresponds to the de-oxygenation coefficient of the organic pollution. Equation (4) states that the pollution is used up as it moves down stream.

The fundamental laws applied to RU38 and FU44 result in:

$$q_{44} = A_{44}v_{44} = A_{44}k_{44}\frac{D}{l_{44}} \quad \text{Equation (5)}$$

$$q_{36} - q_{44} = +A_{38}\frac{dD}{dt} \quad \text{Equation (6)}$$

Substituting $q_{36}$ from Equation (1) and $q_{44}$ from Equation (5) into Equation (6) and rearranging will result in Equation (7).

$$\frac{dD}{dt} + \frac{A_{44}k_{44}}{A_{38}l_{44}}D = \frac{A_{36}k_{36}}{A_{38}l_{36}}L \quad \text{Equation (7)}$$

Where $q_{44}$, $A_{44}$, $v_{44}$, $k_{44}$ and $l_{44}$ are respectively the flow, cross sectional area, face velocity, Darcy's coefficient and length corresponding to FU44; $A_{38}$ is the cross sectional area of RU38. In the fluid analog computer we take $A_{38}$ to be the same as $A_{32}$ then Equation (7) is further simplified to Equation (8) by using Equation (4).

$$\frac{dD}{dt} + rD = kL = L_o k e^{-kt} \qquad \text{Equation (8)}$$

Equation (8) is exactly the same as the classical equation used in river pollution studies.

Where $r = A_{44}\ k_{44}/A_{38}\ L_{44}$ and it corresponds to the re-aeration coefficient of the river. Qualitatively one could predict the solution to Equation (8) by visualizing how D in RU38 will change with time. The change of D is shown on Graph I FIG. 14 in which $D_o$ is the initial oxygen deficit. Solution to equation (8) is available analytically. It may also be easily read off a recorder connected to the fluid analog computer recording the fluid level D in RU38. There are more complicated cases of river pollution problems, that cannot be handled analytically. Some examples of these cases follow. Situations in which there are more than one source of pollution; the pollution source is a non-point source; k, the de-oxygenation coefficient, is not constant; r, the re-aeration coefficient, changes abruptly due to change in cross section or slope of the river; etc. These and other cases can be readily handled by the present invention. For example, to open valve and line 41 periodically simulates the effect of diurnal oxygen production by algae; if the re-aeration coefficient r increases the effect can be taken into account by opening FU42 in FIG. 13 at the proper time. Of course, the details of FU42, like the size of granular material, etc., must have been designed for the particular problem at hand. If the de-oxygenation rate is not first order it can be taken care by using RU32 of suitable non-cylindrical shape. The case of two discharges $t_o$ time (or distance) apart is simulated by an extra subsystem (not shown) in addition to fluid circuit RU32-FU36-TRU33 in FIG. 13. Graph II FIG. 14 shows the oxygen deficit D along a river with two sources of pollution $t_o$ apart. The examples showing the versatility, utility, and simplicity of the present invention to solve real world problem are too numerous and perhaps unlimited to mention here.

C. Other embodiments and modes: In this section some versions, a few of which complement the previous modes of operation of the system, are presented and introduced according to the figures shown on the drawings.

Reservoir units and/or terminal reservoir units shown on FIGS. 2, 13 and 16 may be fully or partly filled with porous media or granular material. When there is no granular material in RU10, FIG. 2 the velocity of the fluid in RU10 is so small that it produces near zero head loss in RU10. When RU10 is filled with sand or other granular material there is friction and head loss in RU10 which is a function of the variable x. This model produces differential equations with variable coefficient. As is clear, this mode of operation of fluid analog computer i.e., reservoir units filled or partly filled with granular materials, demonstrates the versatility of the present invention. One may also use hollow, long tubes, straight or in coils, of proper diameter to produce acceptable head losses as friction units instead of granular filled friction units described before and shown on FIG. 4. Here Darcy's law may not be applicable depending on the flow regime.

Some of the devices or alterations one could install or perform on the basic units of the fluid analog computer are as follows. One may install one-way valves on the friction units so that the fluid flows in one direction. One may also install overflow devices in any reservoir unit to transform it into a terminal reservoir unit. Or one may install an orifice, a weir, or similar device in place of constant level overflow device small enough to cause the flow to back up in the terminal reservoir unit and create a variable level overflow device. Another variation would be to connect the valve and line 12 to valve and line 13 in FIG. 1, to close it to atmosphere to cause non-atmospheric, but equal pressure above the fluid in RU10 and RU14 of FIG. 1. One may also connect the adjacent and/or non-adjacent reservoir unit in the same manner. One may also construct reservoir units with elastic walls (not shown) so that as the fluid level increases or decreases, the reservoir volume expands or contracts. Here we are dealing with variable volume reservoir units.

The construction of a "multi-dimensional" version of the present invention is realized by increasing the number of reservoir units along a line and connecting each two adjacent reservoir units by several friction units. For example in FIG. 1 there may be placed a chain of 30 additional reservoir units to the left of reservoir unit RU10. The first friction unit is placed at the top connecting the top of two adjacent reservoir units e.g., RU10 and RU14. The second friction unit connects the two (RU10 and RU14) a desired short distance below the first friction unit. The third friction unit connects RU10 and RU14 a short distance below the second friction unit. And one continues in this manner until one reaches the last friction unit, FU22 in FIG. 1, which connects the bottoms RU10 and RU14. The same numbers of friction units connect RU10 to the reservoir unit to the left of it (not shown). This continues until all the adjacent reservoir units are connected to friction units.

Figure 21:
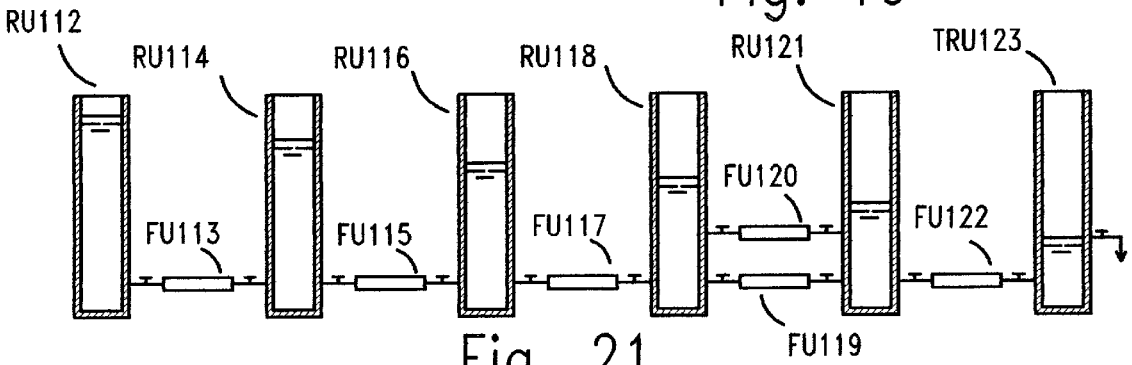
FIG. 21 is a vertical sectional elevation of a predetermined form of analog computer suitable to study rainfall runoff and river flood problems.

One mode of this two dimensional model or two dimensional liquid analog computer is shown on FIG. 21. It shows a vertical sectional elevation of the apparatus which is one mode of the present invention. One function of this is to model the behavior of flood flow in a river. It solves the system of differential equations describing flood flows in a river. In FIG. 21 there are shown RU112, RU114, RU116, RU118, RU121, AND FU113, FU115, FU117, FU119, FU120, AND FU122. TRU 123 is also shown. The forcing functions to the system in terms of flows (or potential head in cases of dam break) are input to the preselected reservoir units to simulate rainfall runoff to the river. The flow through the friction units and the water levels in the reservoir units simulate the flood flows and river stages at different points in the river and at different times. Here the differential equations defining the problem are partial differential equations.

Figure 18:
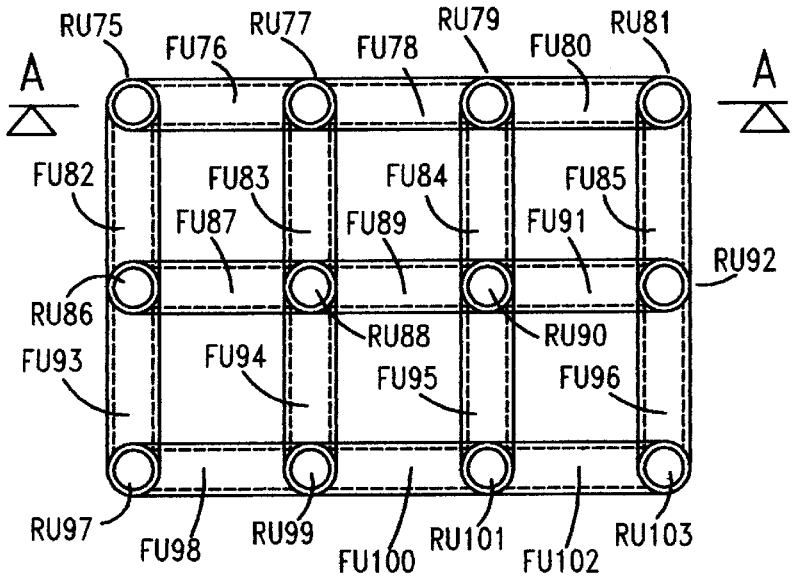
FIG. 18 is the plan view of a physical model or analog model to study groundwater problems.
Figure 20:
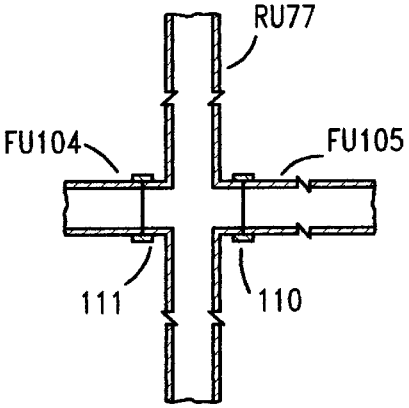
FIG. 20 is the joint in FIG. 19 between a reservoir unit and four friction units where only two friction units are shown.
Figure 19:
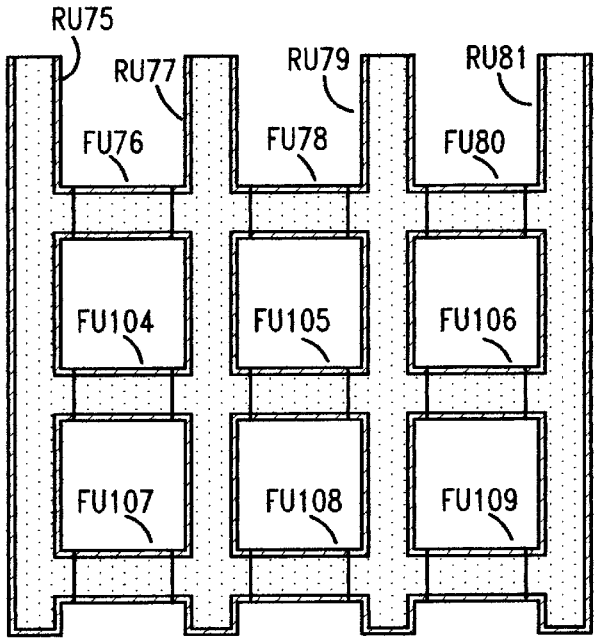
FIG. 19 is a vertical sectional elevation (section A—A in FIG. 18) of groundwater physical model shown on FIG. 18.

The process may be repeated to build three-dimensional fluid analog computers by extending the number of reservoir units in the direction perpendicular to the plane of the paper of FIG. 1. For example RU14 may be extended in a line perpendicular to the plane of the paper of FIG. 1, to include thirty reservoir units. RU10 is also extended likewise in a line perpendicular to the plane of the paper. The new reservoir units to the left of RU10 are also expanded likewise and so are all the other reservoir units. Therefore we have created a square grid containing nine hundred reservoir units. Each reservoir unit is connected to the four closest adjacent reservoir units by friction units in the same manner that was described for RU10 and RU14. In these multi-dimensional fluid analog computers the diameter of the reservoir and friction units may or may not be the same. They may be filled or partly filled with same or different size granular materials. The connection between the units may be of very small length with or without valves. The connections may be realized through commercially available (threaded, slip on, etc.), devices installed at both ends of each friction unit and at the proper points in reservoir units. One mode of this three-dimensional device is shown on FIGS. 18, 19 and 20. FIG. 18 is plan view of a small three-dimensional fluid analog computer and model. This device is able to model groundwater flow problems. FIG. 19 is vertical sectional elevation of FIG. 18 (e.g., A—A section of FIG. 18). RU75, RU77, RU79, RU81, RU86, RU88, RU90, RU92, RU97, RU99, RU101, AND RU103 are connected at equal intervals with FU76, FU78, FU80, FU82, FU83, FU84, FU85, FU87, FU89, FU91, FU93, FU94, FU95, FU96, FU98, FU100, FU102, FU104, FU105, FU106, FU107, FU108, FU109. The number of reservoir units and friction units may be as large as suit the problem. At each joint in each reservoir unit there are connected four friction units with no intervening tubes or valves. The connection 110 and 111 between friction units and a reservoir unit joint is shown in FIG. 20. Any friction unit may be removed to indicate non-porous media in the actual groundwater basin. That part of the joint with a removed friction unit is easily capped to block the flow. This part of invention is a physical model, in the form of finite elements, to study groundwater movements and problems. Any input and output can be forced on the model and pressures at the joints can be easily monitored. Inputs simulate rainfall into the groundwater basin and outputs simulate wells drilled and water pumped out of the basin.

From the foregoing description of the concepts and principles governing the process of building up and the process of utilizing and operating the present invention it is apparent that there are many modifications and alterations to which the fluid analog computer is susceptible. A few of which were mentioned and briefly explained above.

What is claimed is:

1. A fluid analog computer apparatus for modeling the results of a selectable system of differential equations having:

(A) A fluid circuit comprising:

1) At least one RU having an inlet, an outlet and containing a first volume of fluid;

2) At least one FU having an inlet in fluid communication with said RU at a first end of said FU and an outlet at a second end of said FU and a friction element between said inlet an said outlet;

(B) Means imposing a forcing function in the form of fluid flowing into said RU plus fluid potential head in said RU, said forcing function acting on said first volume of fluid to cause a flow of a portion of said first volume through said FU and discharging through said FU outlet and retaining a second volume of said fluid in said RU;

(C) Means defining said fluid to flow through said friction element according to Darcy's law wherein said flow through said FU in combination with said second volume in RU vary as a functional result of said forcing function to model said differential equations.

2. The apparatus according to claim 1, further comprising:

a plurality of fluid circuits, each of said plurality of fluid circuits comprising a plurality of RUs;

each of said plurality of RUs having a volume of fluid, an inlet and an outlet and forcing functions acting on said volume of fluid to cause a flow, at least one FU in fluid communication with each of said plurality of RUs for receiving a flow and having means for selectively connecting said plurality of RUs in a predetermined pattern;

a TRU in fluid communication with at least one of said FUs for receiving the flow therein;

said TRU further having a constant level overflow outlet for releasing the flow therefrom; and at least one inlet of a first one of said plurality of fluid circuits being in serial connection with said overflow outlet of a second one of plurality of fluid circuits;

whereby a volume in each of said plurality of RUs in combination with the flow through each FU define the solution to said system of differential equations.

3. The apparatus according to claim 2 wherein said forcing functions acting on said plurality of RUs is chosen from continuous, discontinuous, constant, variable and period functions and said fluid circuits are connected in a pattern selected from parallel, series, loop or combinations thereof.

4. The apparatus according to claim 2 wherein at least two adjacent RU are connected in fluid communication to each other by a plurality of FU connected therebetween.

5. The apparatus according to claim 2 wherein said plurality of fluid circuits comprises a plurality of RUs to form a three dimensional grid;

at least one of said plurality of RUs containing porous media having a predetermined porosity;

said RUs arranged in a predetermined grid including rectangular grid, and further having plurality of joints;

said joints, having means to selectively connect with said FU, whereby said FUs are in fluid communication with said RU though said joints;

each said joints having means for withdrawing and adding discrete volumes of fluids to the RU and having means for monitoring fluid properties including pressure; and having plurality of TRU at selected points in said grid.

6. The apparatus according to claim 2 further including means to remove and replace at least one FU & one RU.

7. The apparatus according to claim 1 wherein at least one RU includes a forcing function generated by a forcing device chosen from springs, constant head flow producing springs, or motion machines.

8. The apparatus according to claim 1 wherein further at least one RU includes an elastic wall to provide a variable volume as a function of potential head or pressure.

9. The apparatus according to claim 1 wherein further at least one RU includes a shape chosen from cylindrical, spherical, conical, curved wall conical, pyramidal and non-cylindrical.

10. The apparatus according to claim 1 wherein further at least one RU includes at least a portion of its volume filled by porous media.

11. The apparatus according to claim 1 wherein at least one friction unit (FU) comprises:

i. a friction unit inlet in fluid communication with said outlet of said RU at a first end of said friction unit, ii. a friction unit outlet at a second end of said friction unit, and means defining a maximum flow rate between said friction unit inlet and friction unit outlet to restrict the flow through said friction unit to less than said maximum friction unit flow rate.

12. The apparatus according to claim 1 wherein at least one of said RUs is in non-communication with atmospheric pressure surrounding said reservoir.

13. The apparatus according to claim 1 wherein at least one said FU is selected from a multitude of hollow parallel tubes, said multitude of hollow parallel tubes having common inlets and having common outlets; a granular filled tube; a hollow tube; and at least one said RU has transparent walls.

14. The apparatus according to claim 2 wherein at least one said outlet in said TRU is selected from a rectangular weir, a triangular weir, a one way valve, constant flow valve, a plurality of orifices, or a combination thereof.

15. The apparatus according to claim 1 wherein the flow through at least one said FU behaves according to the laws of non-laminar flows.

16. The apparatus according to claim 1, wherein the fluid flowing through the system is chosen from water, oil, colored liquids, air, gases, liquids, compressible fluids, non-compressible fluids, viscous fluids, and non-viscous fluids.

17. A method of modeling a mathematical equation by the steps of:

(A) Selecting a mathematical equation to be modeled;

(B) Providing a fluid analog computer including a fluid circuit having at least one RU and at least one FU;

(C) Providing a TRU in fluid communication with said fluid circuit and having a valved outlet;

(D) Adding an initial first volume having a potential head to said RU and monitoring and observing changes in said potential head with time as a first variable;

(E) Selecting a configuration from looped, series, parallel configuration, and combinations thereof;

(F) Arranging said fluid circuit is connected to a plurality of fluid circuits arranged in said configuration;

(G) Adding predetermined forcing functions to predetermined RU;

(H) Providing predetermined at least one TRU with a valved outlet; and (I) Monitoring changes in potential head, pressure and flow over time in said plurality fluid circuits as a modeled solution to the system of mathematical equations;

(J) Monitoring the change in the liquid level in said TRU with time as a second variable; wherein (K) Modeling said solution to the differential mathematical equation as said changes in said first variable and said second variable with time.

18. A method of modeling a system of two linear differential equations, comprising the steps of:

(A) Selecting two mathematical equations to be modeled;

(B) Providing a first fluid circuit having a RU and a FU;

(C) Providing a TRU in fluid communication with said first fluid circuit and having a valved outlet;

(D) Adding an initial first volume having a potential head to said RU and monitoring and observing changes in said potential head with time as a first variable;

(E) Monitoring the change in the liquid level in said TRU with time as a second variable;

(F) Modeling said solution to the mathematical equations as said changes in said first variable and said second variable with time;

(G) Providing a second TRU in fluid communication with said first fluid circuit and having a constant level overflow device;

(H) Providing a second fluid circuit having a RU and a FU in fluid communications with said first fluid circuit in serial configuration;

(I) Providing a forcing function in the form of a potential head water column to the RU of the second fluid circuit;

(J) Opening all the valves in FU at zero time;

(K) Monitoring the water levels in the RU of said second fluid circuit and said first fluid circuit.

(L) Monitoring the flow rates through said FU and constant level overflow device; and (M) Finalizing the liquid analog computer by determining the size of said RU and FU and porosity of FU and said initial potential head and the time scale so that the monitored water levels are the solution of said differential equations;

wherein the mathematical equation to be modeled is a system of multitude of differential equations, said differential equations chosen from linear, nonlinear, constant coefficient, variable coefficient, ordinary, partial, or combination thereof.

19. A method of modeling a mathematical equation by the steps of:

(A) Selecting a mathematical equation to be modeled;

(B) Providing a fluid analog computer including a first basic fluid circuit having at least one RU and at least one FU;

(C) Providing a TRU in fluid communication with said fluid circuit and having a valved outlet;

(D) Adding an initial first volume having a potential head to said RU and monitoring and observing changes in said potential head with time as a first variable;

(E) Providing said first basic fluid circuit with a TRU having a constant level overflow device;

(F) Providing a second basic fluid circuit having a RU, at least one FU and a TRU with constant level overflow device;

(G) Providing a forcing function in the form of a column of water having a potential head to the RU of said first basic fluid circuit;

(H) Arranging said first and second basic fluid circuits so that the outflow from said constant level overflow device in said first basic fluid circuit form the forcing function in the form of water flow to the of said second basic fluid circuit;

(I) Opening the valves of all said FU;

(J) Monitoring the water levels in said RU of the first and second fluid circuits;

(K) Finalizing the liquid analog computer by determining and selecting the size of the RU, the FU and porosity of FU and said initial water column potential head and the time scale and adding new forcing functions and opening additional FU with time to reflect the changing conditions of river so that the monitored water levels are the solution of said differential equations;

(L) Monitoring the change in the liquid level in said TRU with time as a second variable; wherein (M) Modeling said solution to the differential mathematical equation as said changes in said first variable and said second variable with time;

wherein the results of the mathematical equation to be modeled are the dissolved oxygen changes along a river.

20. A method of modeling a mathematical equations wherein the results of the mathematical equations to be modeled are the changes in the flood stages along a river and branches of the river due to rainstorms occurring on the river water shed and including the steps of:

(A) Selecting a mathematical equation to be modeled;

(B) Providing a plurality of fluid circuits each having a RU and at least one FU;

(C) Providing a TRU in fluid communication with said first fluid circuit and having a valved outlet;

(D) Adding an initial first volume having a potential head to said RU and monitoring and observing changes in said potential head with time as a first variable;

(E) Monitoring the change in the liquid level in said TRU with time as a second variable;

(F) Modeling said solution to the mathematical equation as said changes in said first variable and said second variable with time;

(G) Connecting said fluid circuits in series and branches;

(H) Providing a TRU at a first end of said circuit and having a controlled valved outlet;

(I) Providing a constant flow into said RU for a period of time to give steady flow simulating the base flow of the river;

(J) Providing a predetermined flow with a predetermined pattern to simulate the rainfall runoff to the river at the predetermined RU;

(K) Monitoring the flows and the water levels in FU and RU;

(L) Finalizing the liquid analog computer to define a particular river and its branches by selecting the number of fluid circuits, size of RU and FU, porosity or frictional resistance for each FU, adjusting outlet valve on the terminal RU, forcing functions to reflect the conditions of the river and its floods and choosing a time scale so that the monitored parameters are the solutions to the system of differential equations.

21. The method according to claim 20 wherein further said results to be modeled include the flow and flood stages where said river is overflowing its banks, the flow in storm water runoff collection systems, or the flow and flood stages due to dam break.

22. A method of modeling a mathematical equation by the steps of:

(A) Selecting a mathematical equation to be modeled;

(B) Providing a fluid analog computer including a fluid circuit having at least one RU and at least one FU;

(C) Providing a TRU in fluid communication with said fluid circuit and having a valved outlet;

(D) Adding an initial first volume having a potential head to said RU and monitoring and observing changes in said potential head with time as a first variable;

(E) Selecting a groundwater problem to be modeled;

(F) Providing a plurality of fluid circuits having plurality of RU, said RU having plurality of joints, said joints connected to plurality of FU to form a grid of finite elements;

(G) Selecting predetermined porous media of various size for filling the RU and FU;

(H) Discounting predetermined FUs and RUs from the system to simulate nonporous parts of the groundwater system;

(I) Providing forcing functions in predetermined RU to simulate rainfall;

(J) Providing outflow from predetermined points in said joints to simulate wells and water withdrawals from the system;

(K) Injecting tracers in predetermined RU to simulate pollution entering groundwater;

(L) Monitoring pressure at said points to model the groundwater flow problem; and (M) Monitoring concentration at said points to model groundwater pollution problem;

(N) Monitoring the change in the liquid level in said TRU with time as a second variable; wherein (O) Modeling said solution to the differential mathematical equation as said changes in said first variable and said second variable with time;

wherein the problem to be physically modeled are groundwater flow problems.

* * * * *